US006689309B1

(12) United States Patent
Ranki

(10) Patent No.: US 6,689,309 B1
(45) Date of Patent: Feb. 10, 2004

(54) APPARATUS FOR CLEARING DUST ACCRETIONS IN CONNECTION WITH A SMELTING FURNACE

(75) Inventor: Markus Ranki, Espoo (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 10/070,856

(22) PCT Filed: Sep. 11, 2000

(86) PCT No.: PCT/FI00/00764

§ 371 (c)(1),
(2), (4) Date: Mar. 8, 2002

(87) PCT Pub. No.: WO01/22017

PCT Pub. Date: Mar. 29, 2001

(30) Foreign Application Priority Data

Sep. 23, 1999 (FI) ..... 19992034

(51) Int. Cl.[7] ..... C22B 9/00
(52) U.S. Cl. ..... 266/135; 266/155
(58) Field of Search ..... 266/135, 155, 266/157

(56) References Cited

U.S. PATENT DOCUMENTS

| | | | | |
|---|---|---|---|---|
| 4,475,947 A | * | 10/1984 | Andersson | 266/155 |
| 4,908,058 A | | 3/1990 | Saarinen | |
| 5,741,130 A | | 4/1998 | Hagstrom et al. | |

FOREIGN PATENT DOCUMENTS

| | | | |
|---|---|---|---|
| CA | 1 109 414 | | 9/1981 |
| DE | 3541873 | * | 1/1987 |
| DE | 3 541873 C1 | | 1/1987 |
| EP | 596728 B1 | * | 2/1996 |
| FI | 1 74738 | | 11/1987 |
| FR | 2669104 | * | 5/1992 |
| GB | 2 215 714 A | | 9/1989 |
| WO | 89/03967 | | 5/1989 |

* cited by examiner

*Primary Examiner*—Melvyn Andrews
(74) *Attorney, Agent, or Firm*—Morgan & Finnegan, LLP

(57) ABSTRACT

An apparatus for clearing dust accretions in connection with a smelting furnace, particularly in the contact area between the uptake shaft and waste heat boiler of a flash smelting furnace. The apparatus comprises a wall element (1) arranged in the area (8) to be cleaned, which wall element is movable between at least two positions.

9 Claims, 3 Drawing Sheets

APPARATUS FOR CLEARING DUST ACCRETIONS IN CONNECTION WITH A SMELTING FURNACE

Figure 1:
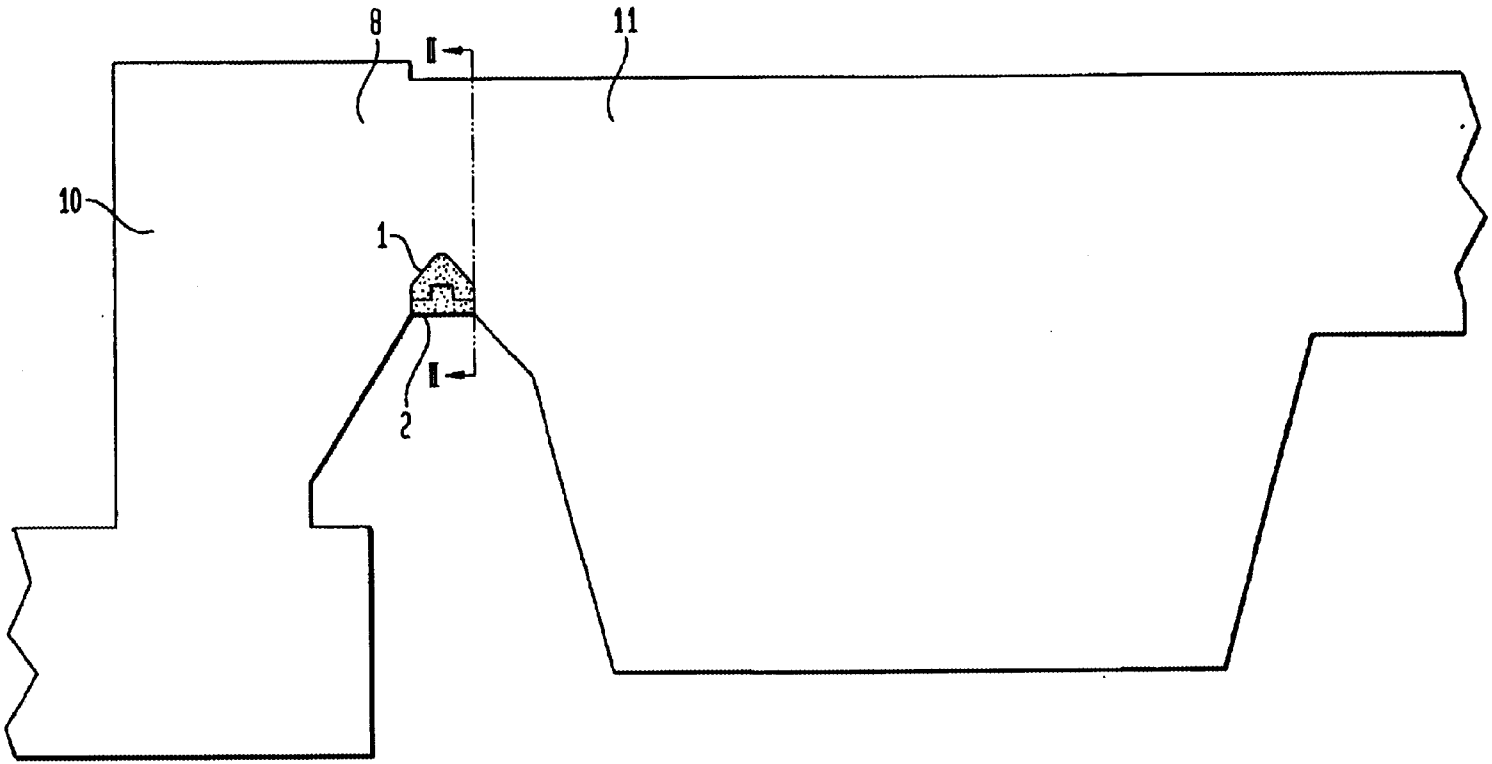

The present invention relates to an apparatus according to claim 1 for clearing dust accretions in connection with a smelting furnace.

Sulfur dioxide containing gases discharged from a smelting furnace, such as a suspension smelting furnace, are typically conducted to a waste heat boiler and further to an electric filter. However, in waste heat boilers connected to suspension smelting, there occur dust accretions owing to the high dust content of exhaust gases, and said dust accretions cause difficulties for the operation of the waste heat boiler as well as for the whole suspension smelting process. Possible losses caused for the producers by interruptions in the suspension smelting process owing to said difficulties are extremely large. The removal of dust accretions has been attempted by many different methods, among which a few are mentioned in the FI patent 74,738. A typical location for dust accretions to be accumulated is the area around the connecting aperture between the uptake shaft of a smelting furnace, such as a flash smelting furnace, and the waste heat boiler. From time to time, dust accretions must be removed from the area of said connecting aperture. This work takes time and is troublesome, because accretions have been removed manually and for instance by means of exploding.

The object of the invention is to realize a novel solution for clearing dust accretions from the connecting area between a smelting furnace and a waste heat boiler, by means of which method the drawbacks of the prior art can be avoided.

The invention is characterized by what is set forth in the appended claims.

The apparatus according to the invention has several remarkable advantages. When the wall part is arranged to be movable, the dust accretion layers can be removed outside the contact area, which speeds up the cleaning process and thus reduces the maintenance time. When clearing means are arranged in connection with the wall elements, the clearing step can be automated, which further reduces the time spent in the cleaning process. If the clearing means are provided at the edge of the aperture or in the vicinity thereof, there is ensured that the location is advantageous and that the accretion particles are dropped in the furnace space and into the waste heat boiler. When the clearing means constitute at least one clearing blade, there is achieved an effective clearing apparatus that is well suited to the conditions of usage. When cooling is arranged in the wall element, and advantageously in the conduit element, too, there is realized an apparatus that operates in an excellent fashion in the conditions of usage. By arranging the wall element surface to be indined at least in one direction, it is possible to control the outlet direction of the accretion partides that are removed from the wall surface and thus to make the wall cleaning process more effective. By means of the apparatus according to the invention, there is achieved a remarkable improvement in the removal of dust accretions in connection with a smelting furnace.

Figure 2:
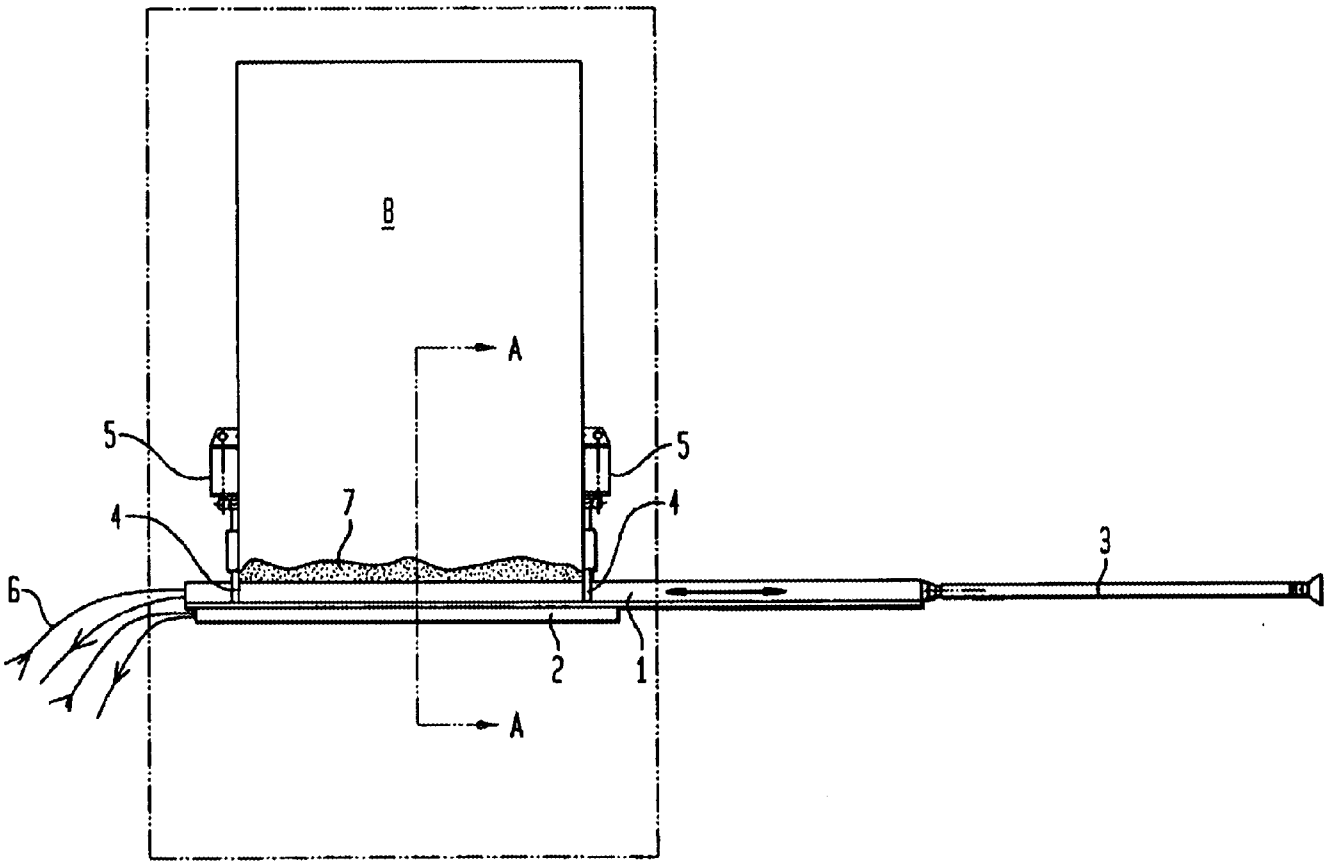
Figure 3:
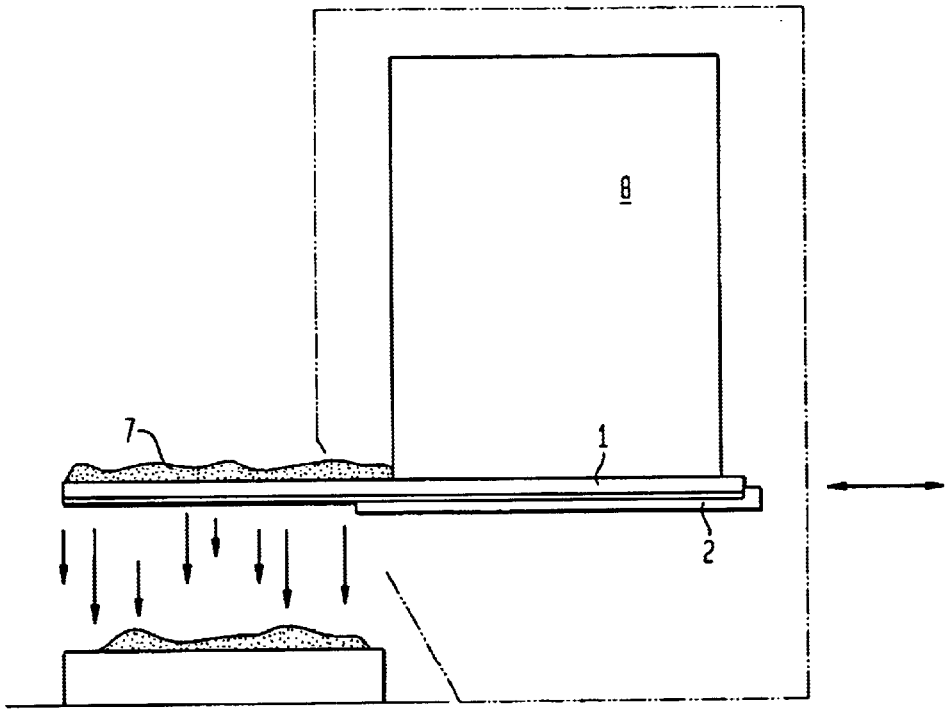
Figure 4:
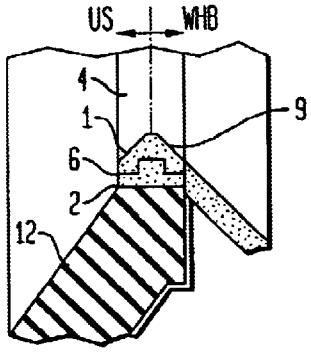

The invention is described in more detail below with reference to the appended drawings, where FIG. 1 represents a preferred embodiment of the apparatus according to the invention, seen in a side-view illustration in partial cross-section, FIG. 2 represents a preferred embodiment of the apparatus according to the invention, seen in a simplified illustration in the direction II—II, FIG. 3 represents another preferred embodiment of the apparatus according to the invention, seen in a simplified illustration, and FIG. 4 represents a detail of a preferred embodiment of the apparatus according to the invention, seen along the line A—A of FIG. 2.

FIG. 1 shows a simplified illustration of a part of a flash smelting furnace, mainly its uptake shaft 10 and waste heat boiler 11 as well as the contact area therebetween. In connection with a smelting furnace and particularly a flash smelting furnace, there is used a waste heat boiler 11, in which case the uptake shaft 10 of the flash smelting furnace is connected to the waste heat boiler 11 via an aperture 8. The apparatus according to the invention for clearing dust accretions 7 in connection with a smelting furnace, particularly in the contact area 8 between the uptake shaft 10 and waste heat boiler 11 of a flash smelting furnace, comprises a wall element 1 arranged in the area 8 to be cleaned, which wall element is movable at least between two positions. In FIGS. 2 and 3, the motion of the wall element 1 is marked with a two-headed arrow.

In order to move the wall element 1, there is provided an actuator 3, which in the embodiment according to FIG. 2 is a combination of cylinder and piston, for example a hydraulic cylinder or a pneumatic cylinder. Typically the actuator 3 can also be for instance a gear rack drive or a chain or wire drive, such as a windlass.

In FIGS. 2 and 4, in connection with the movable wall element 1, there are arranged means 4 for cleaning at least one surface 9 of the wall element. The means 4 for cleaning the surface 9 of the wall element 1 are arranged at the edge of the aperture 8 or in the vicinity thereof. The means for cleaning the wall element surface 9 comprise at least one clearing blade 4 and in connection with the wall element 1 in order to remove the dust accretion layer 7 created on the wall element surface 9. The clearing blade can be stationary, or there can be provided an actuator for moving it. Typically the clearing blade actuator 5 can be a cylinder-piston combination, a screw drive or a gear rack drive. Other suitable actuators are possible, too.

FIG. 4 illustrates a preferred embodiment according to the invention in more detail. There the wall element 1 is arranged to be movable on top of a guide element 2. The movable wall element comprises means 6 for cooling the wall element 1. In the wall element, there are formed channels 6 wherein the cooling agent circulates. The wall element 1 and the guide element 2 are made for example of copper.

The outer surface 9 of the wall element 1 is made to be inclined in at least one direction. In the embodiment illustrated in the drawing, the wall element surface 9 is made to be inclined in two opposite directions, so that it is highest in the middle and descends both towards the uptake shaft (US) and towards the waste heat boiler (WHB). The apparatus according to the invention is arranged at the bottom edge of an aperture made in the wall 12. Typically the wall element 1 constitutes the bottom part of the aperture 8 provided between the uptake shaft 10 and the waste heat boiler 11.

The wall element 1 is movable between a first position, where the wall element or at least a first part of said wall element is located in the area 8 to be cleaned, and a second position where the wall element or at least a first part of said wall element is located outside the area 8 to be cleaned. The wall element 1 is arranged to be movable in the transversal direction in the area 8 to be cleaned.

The apparatus according to the invention is operated for instance as follows. Possible hatches (not illustrated) located at the apparatus according to the invention are opened. The clearing blades 4 are lowered on the surface 9 of the movable wall element 1. By means of the actuator, the wall element is shifted from the first position to the second position, so that the blades remove the dust accretion layer that is created on the surface 9 of the wall element 1 that was earlier located at the aperture 8. As the wall element 1 moves, the essentially stationary blades 4 remove the dust accretion layer 7, in which case, with the shape of the wall element 1 illustrated in FIG. 4, the accretion particles are dropped into the waste heat boiler 11 and conducted, via the uptake shaft 10, to the bottom furnace of the flash smelting furnace.

FIG. 3 illustrates another preferred embodiment of the apparatus according to the invention. There the wall element 1 is movable, in similar fashion as in the embodiment of FIG. 2, but it is not provided with cleaning means. When a dust accretion layer 7 is accumulated in the wall element 1 and should be removed, the wall element is shifted to a position according to FIG. 4, where the area to be cleaned is located outside the walls of the aperture 8. Now the cleaning of the wall element 1 is carried out for example manually outside the area between the furnace and the waste heat boiler.

What is claimed is:

1. An apparatus for clearing dust accretions in connection with a smelting furnace having a waste heat boiler, an uptake shaft and a contact area therebetween, the apparatus comprising a wall element arranged in an aperture area to be cleaned, the wall element being movable between at least two positions, the wall element being movable between a first position, where the wall element or at least a first part of said wall element is located in the area to be cleaned, and a second position, where the wall element or at least a first part of said wall element is located outside the area to be cleaned, the wall, when moved to the second position, permitting dust accretions to be cleared from the wall.

2. An apparatus for clearing dust accretions in connection with a smelting furnace having a waste heat boiler, an uptake shaft and a contact area therebetween, the apparatus comprising a wall element arranged in the an aperture area to be cleaned, the wall element being movable between at least two positions, the wall element being movable between a first position, where the wall element or at least a first part of said wall element is located in the area to be cleaned, and a second position, where the wall element or at least a first part of said wall element is located outside the area to be cleaned, the apparatus further comprising means for cleaning at least one surface of said movable wall element, the wall element being cleared of dust accretions as it moves from the first position to the second position.

3. An apparatus according to claim 2, wherein the means for clearing the surface of the wall element are arranged at the edge of the aperture or in the vicinity thereof.

4. An apparatus according to claim 2, wherein there is provided at least one clearing blade in order to remove the dust accretion layer accumulated on the wall element surface.

5. An apparatus according to any of the claims 1–4, wherein the movable wall element comprises means for cooling the wall element.

6. An apparatus according to any of the claims 1–4, wherein the wall element is arranged to be movable on top of a guide element.

7. An apparatus according to any of the claims 1–4, characterized in that the wall element constitutes the bottom part of the aperture provided between the uptake shaft and the waste heat boiler.

8. An apparatus according to any of the claims 1–4, wherein the wall element is arranged to be transversally movable in the area to be cleaned.

9. An apparatus according to any of the claims 1–4, wherein the outer surface of the wall element is arranged to be inclined in at least one direction.

* * * * *